US005325436A

United States Patent [19]

Soli et al.

[11] Patent Number: 5,325,436

[45] Date of Patent: Jun. 28, 1994

[54] METHOD OF SIGNAL PROCESSING FOR MAINTAINING DIRECTIONAL HEARING WITH HEARING AIDS

[75] Inventors: Sigfrid D. Soli, Sierra Madre; Sriram Jayaraman, Los Angeles; Shawn Gao, Cerritos; Jean Sullivan, Murrieta, all of Calif.

[73] Assignee: House Ear Institute, Los Angeles, Calif.

[21] Appl. No.: 85,652

[22] Filed: Jun. 30, 1993

[51] Int. Cl.[5] ..... H04R 5/00; H04R 29/00; H04R 25/00

[52] U.S. Cl. ..... 381/68; 381/60; 381/26

[58] Field of Search ..... 381/68, 60, 68.6, 68.7, 381/24, 26, 68.1; 128/746; 73/585

[56] References Cited

U.S. PATENT DOCUMENTS 4,739,513 4/1988 Kunugi et al. ..... 381/26

*Primary Examiner*—Curtis Kuntz

*Assistant Examiner*—Sinh Tran

*Attorney, Agent, or Firm*—Lewis H. Eslinger; Jay H. Maioli

[57] ABSTRACT

The insertion effects of hearing aids are determined and compensated to restore the ability to have directional hearing in individuals wearing hearing aids. In one aspect a method involves finding the ratio of the unaided head related transfer function to the aided head related transfer function and then designing a hearing aid filter that is the inverse of that derived insertion effect, thereby restoring the ability to hear interaural differences in aided systems both in level and in time of arrival to improve hearing in the presence of noise. The insertion effects can be derived either through frequency domain analyses, using the above-mentioned transfer function calculations and measurements, or in another aspect through time domain analyses, using optimal filter calculations and measurement obtained using a successive data acquisition system that is subsequently time aligned by recording trigger pulses with the data.

27 Claims, 9 Drawing Sheets

MEASUREMENTS FOR BTE FILTER DESIGN

| CONDITION | SOURCE AZIMUTH | EAR | CONSTANT DELAY (msec) | LEFT/RIGHT DIFFERENCE |
|---|---|---|---|---|
| UNAIDED | 0° | LEFT | 3.81 | 0.01 |
| | 0° | RIGHT | 3.80 | |
| | 270° | LEFT | 3.52 | -0.64 |
| | 270° | RIGHT | 4.17 | |
| AIDED | 0° | LEFT | 5.88 | 0.008 |
| | 0° | RIGHT | 5.88 | |
| | 270° | LEFT | 5.61 | -0.69 |
| | 270° | RIGHT | 6.30 | |

MEASUREMENTS FOR ITE FILTER DESIGN

| CONDITION | SOURCE AZIMUTH | EAR | CONSTANT DELAY (msec) | LEFT/RIGHT DIFFERENCE |
|---|---|---|---|---|
| UNAIDED | 0° | LEFT | 0.14 | 0.03 |
| | 0° | RIGHT | 0.11 | |
| | 270° | LEFT | -0.12 | -0.66 |
| | 270° | RIGHT | 0.54 | |
| AIDED | 0° | LEFT | 2.04 | 0.05 |
| | 0° | RIGHT | 1.99 | |
| | 270° | LEFT | 1.76 | 0.68 |
| | 270° | RIGHT | 2.44 | |

FIG. 3

METHOD OF SIGNAL PROCESSING FOR MAINTAINING DIRECTIONAL HEARING WITH HEARING AIDS

BACKGROUND OF THE INVENTION

1. Field of the Invention

This invention relates generally to a method for improving conventional hearing aids and, more particularly, to a method for maintaining directional hearing of an individual wearing hearing aids, either behind the ear or in the ear.

2. Description of the Background

A hearing aid is generally a simple device consisting of a microphone, an amplifier, and an output transducer. Hearing aids are classified either as in-the-ear (ITE), in which the entire device resides in the wearer's ear, or behind-the-ear (BTE), in which the amplifier, microphone, and battery are arranged behind the ear with the output transducer being generally at the ear opening. It is known to provide for some shaping of the gain or amplifier response depending upon the specific hearing deficiencies of the wearer by emphasizing higher or lower frequencies and altering the gain as appropriate. One major complaint of hearing aid wearers is that it is difficult to enjoy the benefit of the hearing aid in a noisy environment because the noise is amplified by the same amount as the signals of interest, which might be speech or music. Using filters to filter out the signals of interest from the noise has proven to be a less than satisfactory solution, because for one reason the frequencies of the signals of interest often overlap the frequencies of the noise that is masking those signals.

OBJECTS AND SUMMARY OF THE INVENTION

Accordingly, it is an object of the present invention to provide a method to improve the ability of an individual wearing hearing aids to hear in the presence of noise.

Another object of this invention is to provide a system for providing the coefficients of filters that will maintain the capability for directional hearing of an individual wearing hearing aids.

The present invention contemplates the use of either a human or a manikin and can use either a manikin ear canal microphone or a probe tube in the human subject or other suitable means of acoustic coupling. The distinguishing characteristic of the optimal filter method of this invention is that the filter coefficients can be obtained directly and minimum phase calculations are not required.

In accordance with an aspect of the present invention, a method is provided to generate hearing aid filters that preserve interaural differences, in both level and time of arrival, of sounds at the ears of a hearing aid wearer. In order to preserve such interaural differences, filters are employed whose filter characteristics are determined by measuring interaural time and level differences present without any hearing aid devices for various sound source azimuth locations, determining the interaural differences present with hearing aids, and then selecting the filter characteristics to equalize the undesirable influence of the hearing aids. The insertion effects of the hearing aids are equalized by the filters, which have an average response that is the ratio of the unaided to aided head transfer function for each ear and each different azimuth location.

One aspect of the present invention involves directly measuring one or more aided and unaided head related transfer functions (HRTF) of a human subject or obtained using a manikin. This method uses frequency domain computations. The hearing aid user listens through the hearing aid on the manikin by using a dummy head sound reproduction system. The aided and unaided transfer functions from the sound source to the eardrum are measured with a spectrum analyzer, and the ratio of these transfer functions is computed to obtain a target equalization response of the hearing aid filter. A second magnitude component is then added to the magnitude component of the target equalization response, in order to compensate the frequency dependent hearing loss of the wearer. The resulting magnitude and phase are used as a target for weighted least squares filter design. The filter designed in this fashion is a finite impulse response filter (FIR). Using the present invention it is possible to produce a hearing aid in which the directional hearing abilities of a hearing impaired individual are maintained.

In an alternate approach according to this invention the above technique is refined and the use of the dummy head or manikin is eliminated. More specifically, in this aspect of the invention an optimal filter is established without measurement of the HRTF. In this approach the unaided and aided transfer signals are acquired sequentially in practice but in such a way that they can be analyzed as if they were acquired simultaneously. The unaided signal is treated as the desired signal and the aided signal is treated as the reference signal. An optimal filter is computed to minimize the error between the desired (unaided) and reference (aided) signals. The optimal filter response thus equalizes the insertion effects of the hearing aid. This is accomplished by using a two-channel recording of a test signal, such as white noise. One channel contains the noise signal and the other channel has a trigger pulse at the onset of the noise signal. The trigger pulse is used to synchronize the sampling of the signal obtained from the ear canal in order to allow sequential acquisition of the desired and reference signals from different source azimuths in the sound field. Then all the aided signals are summed and all the unaided signals are summed to form two composite signals. These two composite signals are then used to implement the optimal filter response.

The above and other objects, features, and advantages of the present invention will become apparent from the following detailed description of illustrative embodiments thereof, to be read in connection with the accompanying drawings.

BRIEF DESCRIPTION OF THE DRAWINGS

FIG. 3 is a table showing constant delay components of transfer function measurements as examples of values used in designing corrective filters for hearing aids according to the present invention;

DETAILED DESCRIPTION OF PREFERRED EMBODIMENTS

The present inventors previously determined in a study using normally hearing subjects that directional hearing was poorer with conventional hearing aids than without hearing aids. It was further determined that directional hearing improves the ability to hear sounds of interest in the presence of noise. Moreover, it was determined that hearing aids probably distort or eliminate important acoustical cues that are used for normal directional hearing. The present invention then seeks to equalize the hearing aid's insertion effects in order to restore sound cues that permit normal directional hearing. Such sound cues are known as interaural differences and are present both in signal level, that is, amplitude, and in signal time of arrival, that is, phase. The interaural level differences can result in an improved signal to noise ratio (S/N) in the shadowed ear, that is, the ear away from the noise source, and the interaural time differences produce binaural masking effects that improve hearing in the presence of noise. The present invention reduces the effects of the hearing aid insertion on the amplitude and phase of the source-to-eardrum transfer functions, which are hereinafter referred to as head related transfer functions (HRTF). By following the description set forth below, it is possible to design a digital filter, such as a transversal filter or finite impulse response filter (FIR), to equalize the influence of the hearing aids on the HRTF. Thus, the present invention provides a method and apparatus for designing binaural hearing aids that preserve important acoustic information for normal directional hearing that result in improved hearing aid performance.

These binaural cues that permit directional hearing to occur are based upon the fact that the transfer functions from a signal source at a given, nonzero azimuth relative to the left and right eardrums are different. Furthermore, because these differences in the transfer functions occur due to the distance between the ears, the acoustic head shadow, and the differential filtering produced by left and right pinnas and the ear canals, all of which are slightly different for each individual person, a strictly mathematical or theoretical analysis resulting in usable filters cannot be made. Therefore, the present invention provides a method and apparatus for determining the optimum filter coefficients using an experimental setup for both the in-the-ear hearing aids, as well as behind-the-ear hearing aids. This test involves deriving the unaided head related transfer function and finding the head related transfer function that is present when hearing aids are installed. Then the filters are designed to equalize the influence of the hearing aids on the head related transfer function. Thus, the filter response becomes the ratio of the aided to unaided head related transfer function for each ear and for each azimuth of the sound source.

Figure 1:
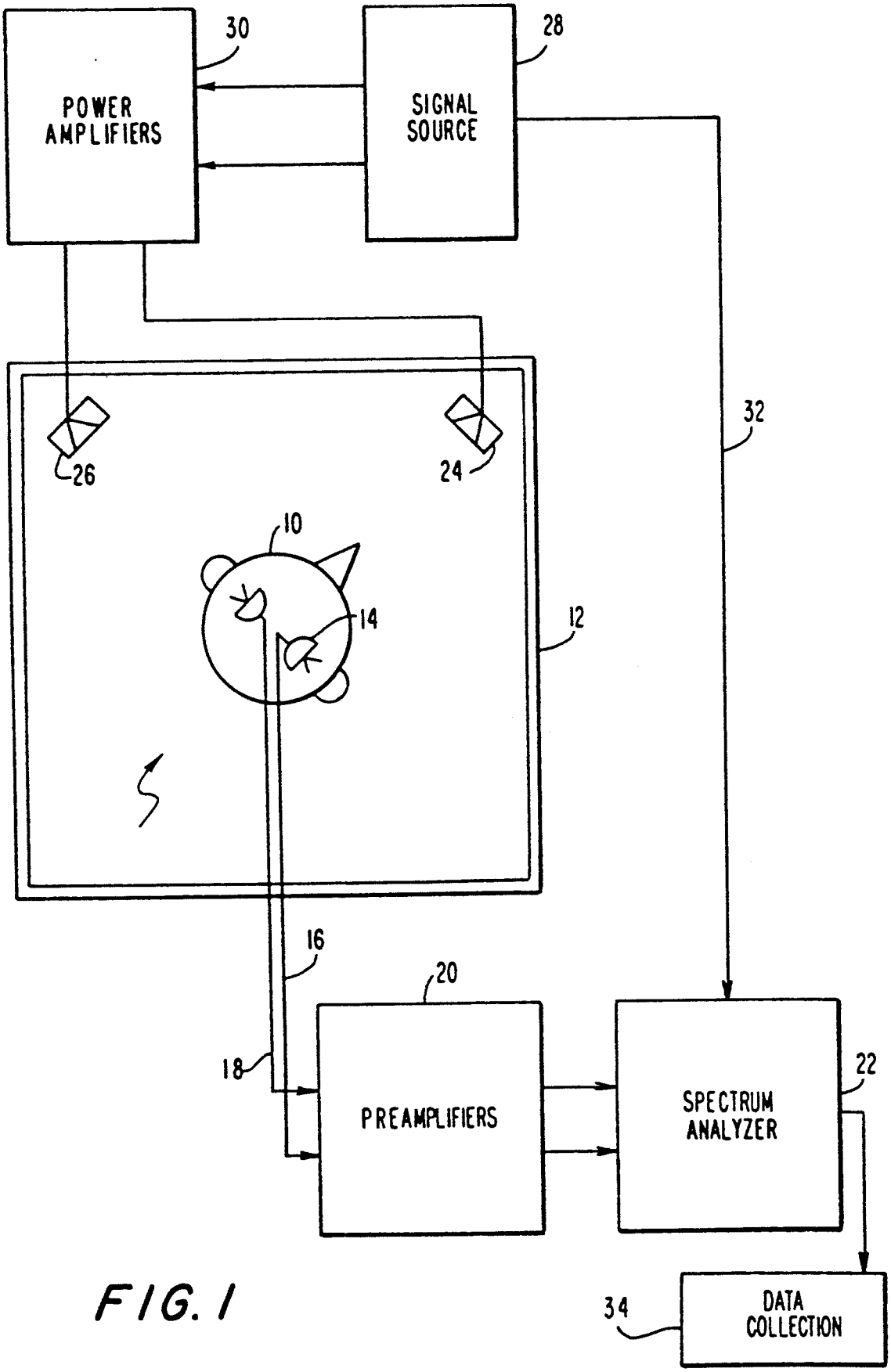
FIG. 1 is a schematic in block diagram form of a system used to measure a head related transfer function using a human subject or a manikin.

FIG. 1 shows a system for measuring the head related transfer function in the unaided situation that applies to either a human subject or a manikin. A human subject or manikin 10 is located inside a quasi-anechoic space 12 created by placing sound deadening material on interior surfaces of a double-wall test chamber. In the case of using a manikin 10 it is equipped with microphones located in the ear canal inside the head at the approximate locations of the eardrums, and such microphones are shown typically at 14. These microphones simulate the physical ear and provide output signals on lines 16 and 18 fed to a preamplifier 20. In the case of a human subject 10, the microphones 14 are located in the ear canals using probe tubes. In addition, any other suitable means of acoustic coupling could be employed. The two-channel output from the preamplifier 20 is fed to a spectrum analyzer 22, which may be functionally embodied as a computer. Thus, the binaural set-up will be recognized. The sound source for the microphones 14 that form the artificial ears in the case of the manikin is specially tailored to consist of signals that represent sounds available in the real world that are produced in loudspeakers 24 and 26 located in the test chamber 12. These sounds are derived by a sound source 28 in which the two channel signals are filtered for preemphasis and de-emphasis and amplitude spectrum shaped before they are amplified in power amplifier 30 and fed to the transducers 24 and 26. Various azimuth angles can be obtained by rotating the head of the human subject or manikin 10 and thereby changing the orientation of the artificial ears or microphones 14 relative to the sound sources 24 and 26 or by feeding the signal to either loudspeaker 26 for 0° azimuth or to loudspeaker 24 for 270° azimuth. The spectrum analyzer 22 receives a reference input from the sound source on line 32 so that the level and phase measurements in the spectrum analyzer can be all made from the same reference point. The measurements obtained by the spectrum analyzer 22 are fed to a data collection device 34, which may comprise a digital tape recorder, for example. The spectrum analyzer 22 can be a two-channel FFT analyzer, for example.

Figure 2:
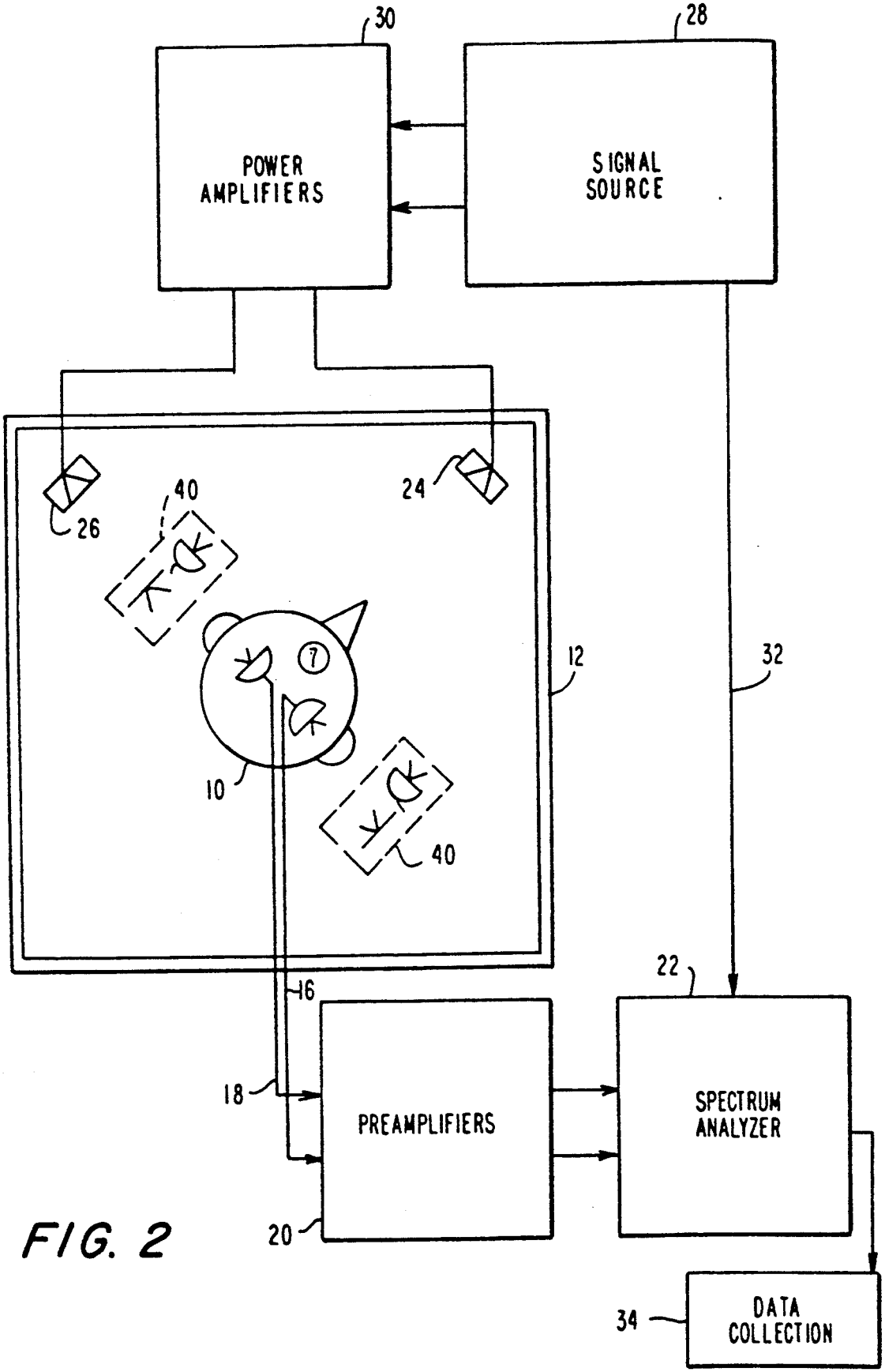
FIG. 2 is a schematic in block diagram form of a system used to measure a head related transfer function using a human subject or a manikin and with hearing aids shown within dashed lines.

FIG. 2 shows a system for determining the head related transfer functions in an aided embodiment, in which hearing aids 40 are shown installed. These hearing aids 40 can be installed on the manikin or may be placed in the ear or behind the ear of the human subject. All other elements of the system shown in FIG. 2 are the same as in FIG. 1 and are provided with the same reference numbers and need not be described in detail again.

The data from the two-channel FFT analyzer, that is, spectrum analyzer 22, for each head related transfer function, as stored in data collection device 34, is analyzed and processed in keeping with the following steps in order to obtain the aided and unaided transfer functions that then provide target amplitude and phase responses for use in equalizing the hearing aid insertion effects. Generally, the amplitude and phase effects of the hearing aid transducer, the ear module placement, and the hearing aid circuits on the unoccluded sound field to ear drum transfer function for the human subject or the manikin are computed. This information then specifies the amplitude and phase response of the FIR filter that will be used to invert the effects of the hearing aid on the unoccluded transfer functions. The filter can be designed using the frequency sampling technique or other filter design techniques or programs. In any event, the filter coefficients are selected to compensate for the insertion effects of the hearing aid, thereby restoring the otherwise lost directional cues. Once the proper filter coefficients have been selected, a further measurement can be made in which the hearing aid uses the filter. Then, that head related transfer function should match the unoccluded transfer function. In other words, the head related transfer function derived using the system of FIG. 1 should match the head related transfer function derived using the system of FIG. 2, when the appropriate filters are employed in the hearing aids. In the event that such head related transfer functions do not match, then the filter weighing coefficients can be adjusted accordingly until a match is found.

Initially, the data obtained relative to the head related transfer functions from the system of FIG. 2 is converted from rectangular coordinates into a frequency/amplitude/phase format. The data points for the amplitude and phase measurements are preferably taken every 16 Hz. The phase response is unwrapped, that is, the group delay is extracted and the amplitude and phase plots of the measurements are produced. Using such plots the bandwidth over which the measurements can be regarded as reliable is determined. Based upon such reliable bandwidth, the head related transfer functions are truncated at the upper and lower ends to include only the determined reliable bandwidth. For example, in the case of the behind-the-ear measurements, such bandwidth was from 400–6384 Hz and for the case of in-the-ear measurements the bandwidth was 200–5000 Hz. Then, the minimum phase representation of each head related transfer function is determined by assuming that the non-minimum phase component of each response can be characterized by pure delay. The pure delay component is computed by least-squares fitting a linear function to the unwrapped phase data over the truncated reliable bandwidth. The slope of this function in degrees/Hz is converted to time and subtracted from the unwrapped phase response. The residual nonlinear phase component is used as the minimum phase representation, which is invertible as required to obtain the equalization response. The magnitude and phase components of the minimum phase transfer function are separated and the curve smoothed using a five-sample moving average with uniform weighting in two passes for each component of the head related transfer function. Other smoothing procedures are equally advantageous.

The desired transfer function that is necessary to equalize the amplitude and phase insertion effects of the hearing aid is based upon the ratio of the unaided/aided head related transfer function for each hearing aid, for each ear, and for each source azimuth. Complex division of the two transfer functions provides the response for each hearing aid filter according to the invention. The filters are designed using the weighted, least squares, frequency sampling technique that permits the specification of an arbitrary target amplitude and phase response at any number of arbitrary frequency samples. In the instant invention, the response was obtained by interpolating 400 evenly spaced frequency samples over the Nyquist bandwidth.

FIG. 3 shows data relating to the constant or pure delay component of the aided and unaided measurements in table form. As seen from FIG. 3, the differences in constant delay between the two behind-the-ear and in-the-ear hearing aids was less than 20 microseconds for the 0° azimuth measurement condition. This is seen by comparing the unaided left and right ear differences at a given azimuth to the aided differences.

Figure 4B:
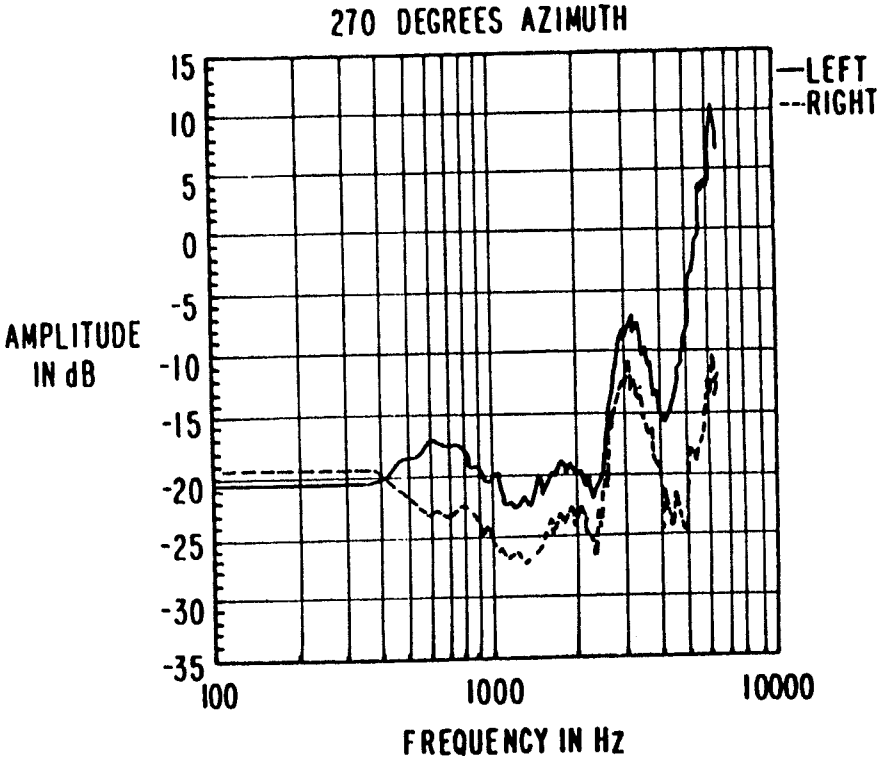
FIGS. 4A and 4B are filter response curves suitable for correcting amplitude insertion effects for a 0° azimuth and a 270° azimuth in an in-the-ear hearing aid.
Figure 4A:
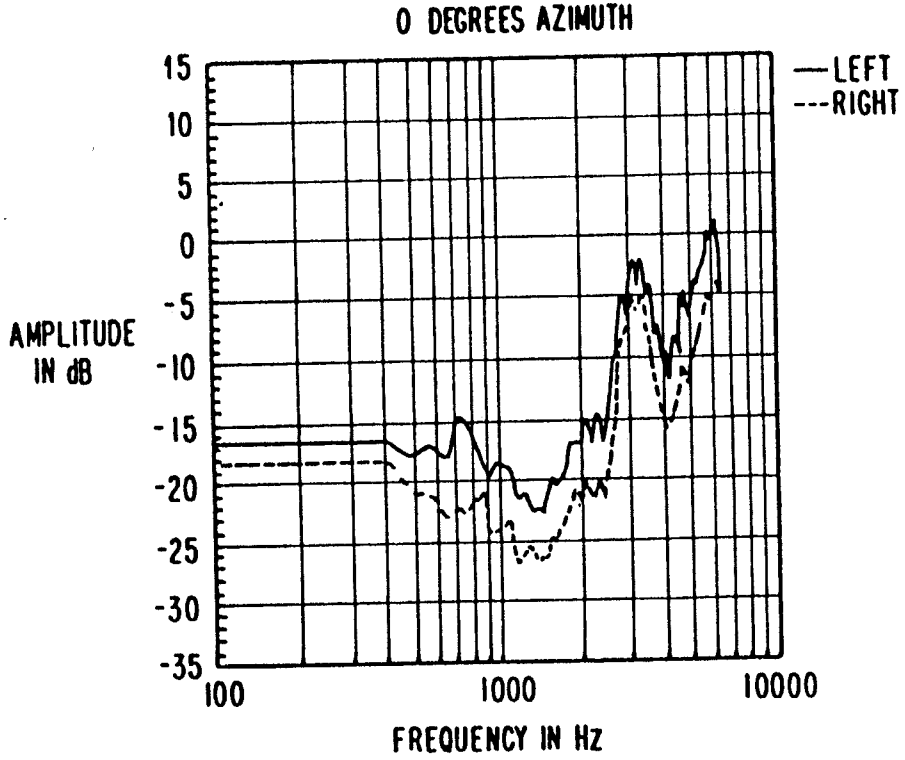
Figure 5B:
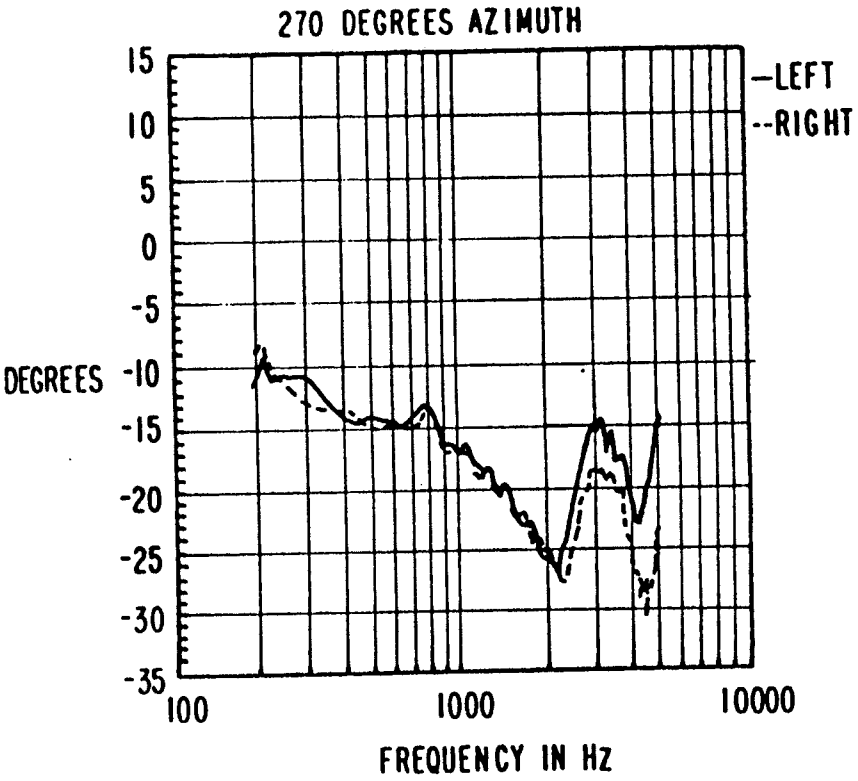
FIGS. 5A and 5B are filter response curves suitable for correcting phase insertion effects for a 0° azimuths and a 270° azimuth for a behind-the-ear hearing aid.
Figure 5A:
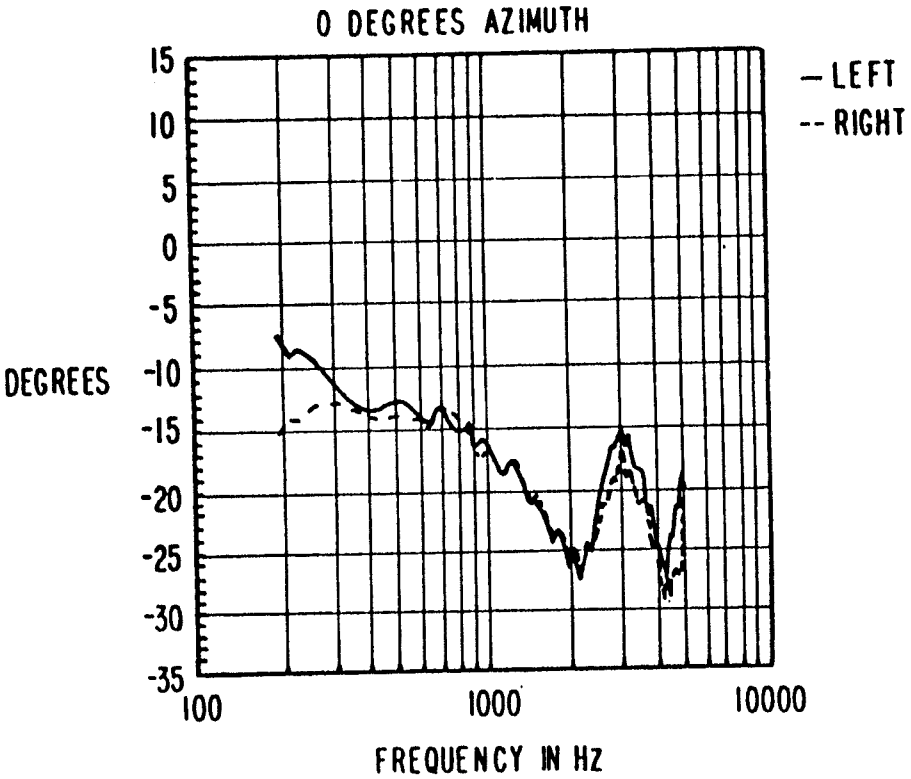

FIGS. 4A, 4B and 5A, 5B show the filter responses necessary to correct the amplitude and phase insertion effects of the hearing aids at different azimuth angles, that is, the frequency responses of the filters designed according to the present invention. The differences between the left and right phase responses for 0° and 270° azimuths for the in-the-ear hearing aids are shown in FIGS. 4A and 4B. The differences between the left and right amplitude responses for 0° and 270° for the behind-the-ear hearing aid are shown in FIGS. 5A and 5B. It will be noted that behind-the-ear differences were distributed over the entire response bandwidth, whereas in-the-ear differences were restricted to frequencies 2 kHz and higher. Also, as expected interaural differences are markedly present at the 270° azimuth position. The filter itself can be designed using any of the several well-known filter techniques provided that the filter coefficients are selected to implement the derived ratio between the unaided and aided head related functions. In other words, once the amplitude response and phase response is specified the filter coefficients can be determined.

Accordingly, it is seen by following the above described method steps and in utilizing the apparatus shown in FIGS. 1 and 2 that it is possible to design a hearing aid filter that compensates for insertion effects of the hearing aid and restores the interaural differences necessary in obtaining directional hearing and, thus, improve the ability of a hearing aid wearer to discern desired signals in the presence of noise.

In another embodiment of the present invention, the spectrum analyzer and the computation of the transfer function ratio are eliminated. This other embodiment, involving optimal filter computations, is a time domain method that allows the filter coefficients to be obtained directly and that avoids the problem of having to estimate or compute minimum phase.

Figure 6:
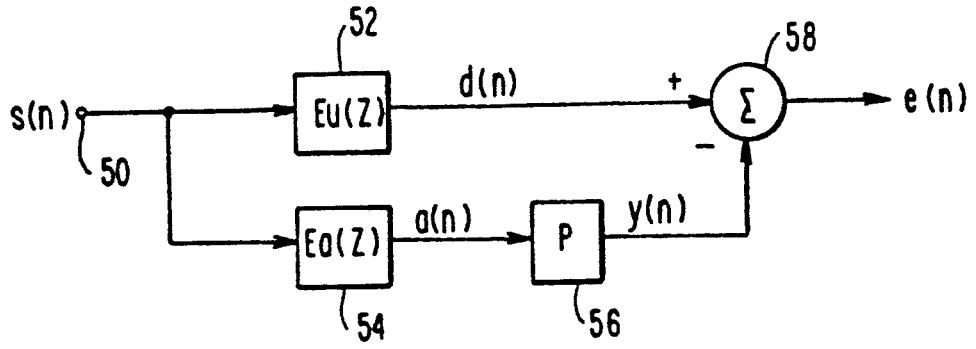
FIG. 6 is a signal flow path diagram showing transfer functions of blocks arranged according to a second embodiment of the present invention.

FIG. 6 shows a system for practicing this time domain method, in which fed in at input 50 is a white noise signal that is fed to the unaided ear transfer function block 52 that produces a signal d(n). The input signal s(n) is also fed to the hearing aid transfer function block 54. The desired equalization transfer function is modeled as block 56 that receives the output of block 54. The difference between the two signals is taken in a summer 58.

Typically, in computing an optimal filter the desired signal and the reference signal are obtained simultaneously. In this embodiment the aided signal is treated as the desired signal, and the unaided signal is treated as the reference signal. In a situation involving a hearing aid, such as the present one, it is essentially impossible to obtain the unaided signal and the aided signal simultaneously. According to this embodiment of the present invention, however, by synchronizing the means of data acquisition used for recording the signals in the ear canal with the onset of the signal in the sound field, the two recordings can be obtained sequentially but processed as if they had been recorded simultaneously. Synchronizations can be achieved by using a two-channel recording of the test signal in which one-channel contains the signal and the other contains a trigger pulse representing the onset of the signal. The trigger pulse is used to initiate the analog-to-digital converter that samples the signal in the ear canal, either from the probe tube or from some other microphone. The triggering occurs at the onset of the signal in the sound field rather than at the arrival of the signal in the ear canal in order to obtain accurate phase measurements in equalization. Any other means of self-triggering the sampling or data acquisition with the onset of the signal in the soundfield would work equally well. According to this procedure, multiple sets of desired and reference signals can be obtained from different source azimuths in the sound field. For example, from four to six different azimuths ranging from directly in front of the listener to directly perpendicular to the ear being measured are obtained. All of the acquired aided signals are then summed and all of the acquired unaided signals are summed, with the two composite signals used in the optimal filter calculations. By providing the multiple sets of desired and reference signals, it is possible to weight one or more of the composites in order to favor or emphasize certain azimuths in the filter calculations.

An advantage of this above-described technique in filter design is that the equalization filter response is obtained in the time domain and therefore does not require head related transfer function (HRTF) measurements and minimum phase representations. Note that in the previously described method, the group delay is removed prior to the filter coefficient calculation to estimate minimum phase, and this adds to the complexity of the computations.

Another advantage of the optimal filter approach is that the magnitude component needed to compensate frequency dependent hearing loss can be incorporated. This magnitude component is calculated from an audiogram separately for each ear, in the well-known fashion. The hearing loss compensation is then applied with one of two alternative methods of post-processing. According to the first method, the filter coefficients for a linear phase filter that corrects for hearing loss are convolved with the filter coefficients for the optimal filter. The resulting set of filter coefficients will both equalize the hearing aid and compensate for hearing loss. According to the second method, the signal acquired in the unaided condition is filtered with the linear phase filter that corrects for hearing loss prior to computation of the optimal filter. When the optimal filter coefficients are calculated in this fashion, the resulting optimal filter response incorporates both the equalization of the hearing aid and the compensation for hearing loss.

As described above, this optimal filter design method involves synthesizing a white noise signal with Gaussian distribution and recording that signal on channel A with a digital audio tape recorder. On channel B a synchronizing pulse is recorded. For a fixed sound source location, the unaided eardrum digital signal is recorded using a probe tube microphone in the ear of the intended wearer. The same eardrum signal is then acquired with the hearing aid module in place. The hearing aid processor is connected in a pass-through arrangement, so that only the transducer and the fixed circuit elements are in the signal path. In this fashion, pairs of aided and unaided signals are acquired for various azimuths, during which time the power of the sound source is held constant. By using the synchronizing pulse, all of the signals that are acquired are therefore synchronized, so that the composite aided and unaided signals can simply be obtained by summation. From the two composite signals, the various estimates of the correlations values require to set up the discrete time Wiener equations are computed. The appropriate auto-correlation matrix R in the cross-correlation matrix P are computed by estimating elements by the sample averages. The FIR Wiener solution is $w=R^{-1}P$. This is a non-minimum-phase transfer function that equalizes, in the sense of mean square error minimization, the amplitude and phase insertion effects of the hearing aid.

The operation of this method in relation to the signal flow path diagram of FIG. 6 showing the transfer functions for the elements used in the method described above will now be explained. Specifically, fed in at input terminal 50 is the white noise signal with a Gaussian distribution, which is fed to the unaided ear transfer function block 52 to produce an eardrum signal d(n) in the unaided condition. Following the above procedure, the input signal is also effectively fed through the hearing aid transfer function block 54. The desired equalization transfer function is modeled as block 56 producing the equalized signal y(n). The ear drum signal in the aided condition is represented as signal a(n). Signals a(n) and d(n) are used to compute the optimal filter 56 to minimize e(n) which is the difference between d(n) and the equalized signal y(n). This difference is obtained at block 58. From FIG. 6 it will be noted that this optimal filter will minimize the mean square error between the unaided and aided condition eardrum signals. This means equalizing the hearing aid output signal to match the unaided signal, which is the desired signal. In practicing this method shown in the transfer function signal flow diagram of FIG. 6, it is first necessary to record the unaided eardrum digital signal d(n) and subsequently to record the aided eardrum signal a(n). The procedure for this is as described above. Once these signals are obtained then the various estimates of the correlation values required to solve the discrete-time Wiener-Hopf equations are computed. Thus, it is seen that the spectrum analyzer is not required in developing this equalization filter.

Figure 7:
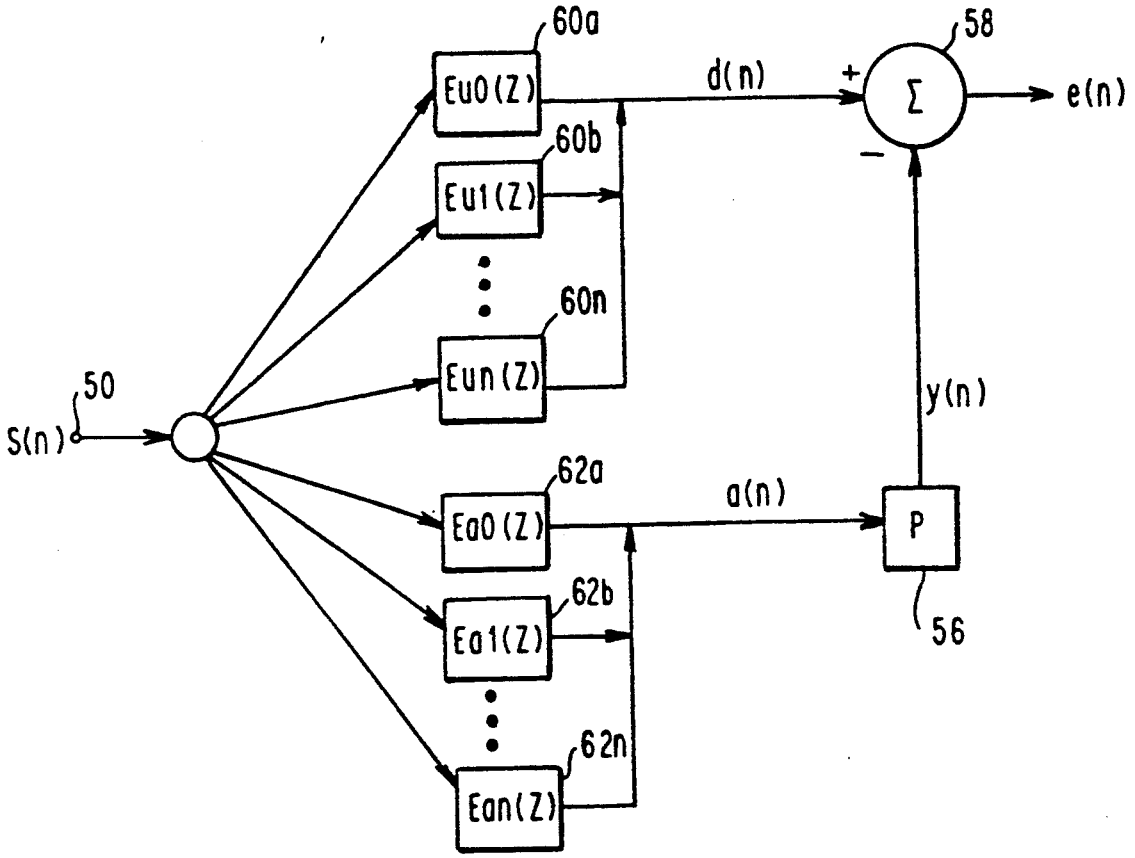
FIG. 7 is a signal flow path diagram of an expanded version of the embodiment of FIG. 6.

Because the aided and unaided ear transfer functions are dependent on the azimuth, the head shadow, and the microphone placement, in designing a single optimal filter over all these conditions the sound source signal s(n) must be omni-directional or diffuse, so that components arriving from all azimuths can be included in the calculations and also the effects of the head shadow for the various azimuths must be included. Thus, as shown in FIG. 7, the system of FIG. 6 is expanded so that a bank of transfer functions 60*a*, 60*b*, . . . 60*n* representing the various azimuth paths for the unaided condition are provided. Similarly, a number of transfer functions in the aided condition 62*a*, 62*b*, . . . 62*n* are provided with, once again, the eardrum signals being obtained by summing the contributions from all of the discrete sources, as represented in FIG. 7.

Figure 8:
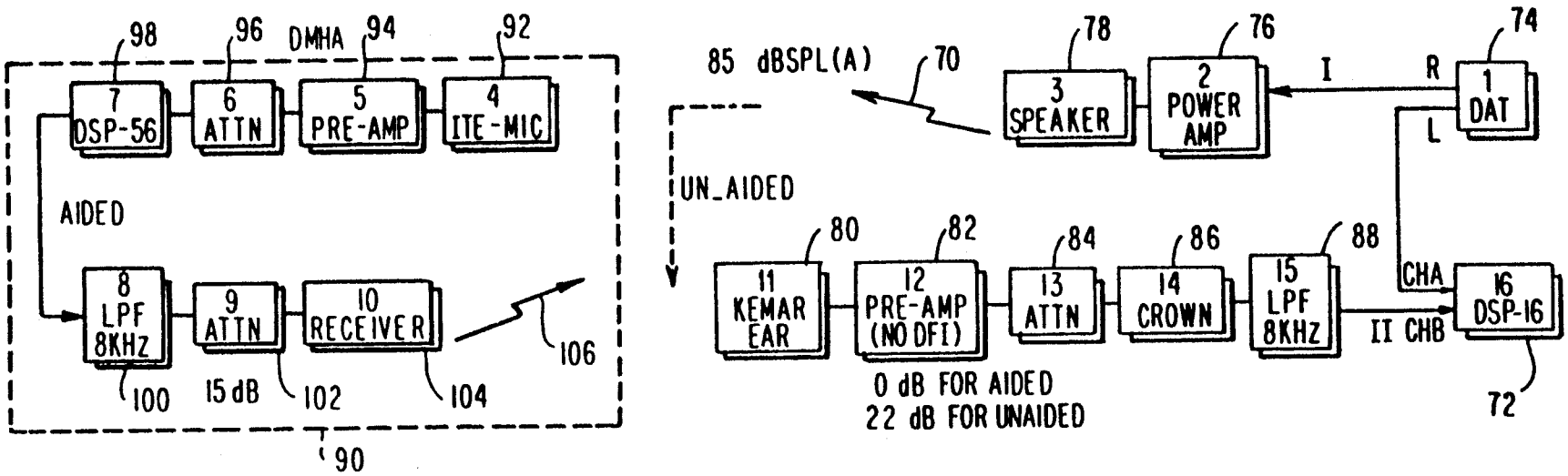
FIG. 8 is a schematic in block diagram form of a data acquisition system according to an embodiment of the present invention.

FIG. 8 shows the overall system arrangement for acquiring the data used in the filter design and, in this case, the testing signal was presented in the sound field at the level of 85 dbSPL(A), as represented by the sound waves shown generally at 70. The sound waves are provided at different azimuths and the signal then acquired from a probe tube microphone in the human ear canal or from a manikin ear canal microphone under the unaided condition in which the test signal was passed directly through the ear to a digital signal processor 72 so that the signal path is then from the sound source 74 represented by digital audio tape recorder through a power amplifier 76 and loudspeaker 78 to produce the sound waves 70. The sound waves are then passed in through the ear 80, either the manikin or the human ear, and through a preamplifier 82, attenuator 84, amplifier 86, and low-pass filter 88 directly to the digital signal processor 72. In the aided condition, the test signal as represented at 70 is presented in the sound field and fed through the so-called digital master hearing aid 90 and then played back into the either the manikin's ear having the microphone 92 or the probe tube microphone in the ear canal of the human subject. The digital master hearing aid 90 is comprised of the in-the-ear microphone 92, a preamplifier 94, an attenuator 96, a digital signal processor 98, a low-pass filter 100, an attenuator 102, and a receiver 104. The receiver 104 is, in effect, a transducer or speaker that produces sound waves represented at 106 that are then received by the ear 80 and passed on to the digital signal processor 72.

In this way, the data is obtained in order to perform the computations of the optimal filter (FIR) coefficients. The FIR digital Wiener filter is computed by estimating elements of the appropriate auto correlation matrix R and the cross-correlation vector P and the elements are computed by replacing expectations by sample averages. Because this matrix R is a Toeplitz matrix, computing a single row of the matrix is sufficient. In addition, it is known from estimation theory that sample estimates of Gaussian processes are optimal in the maximum likelihood sense and are consistent, that is, they converge to their true values. As noted above, the discrete time Wiener solution is $w=R^{-1}P$.

Figure 9:
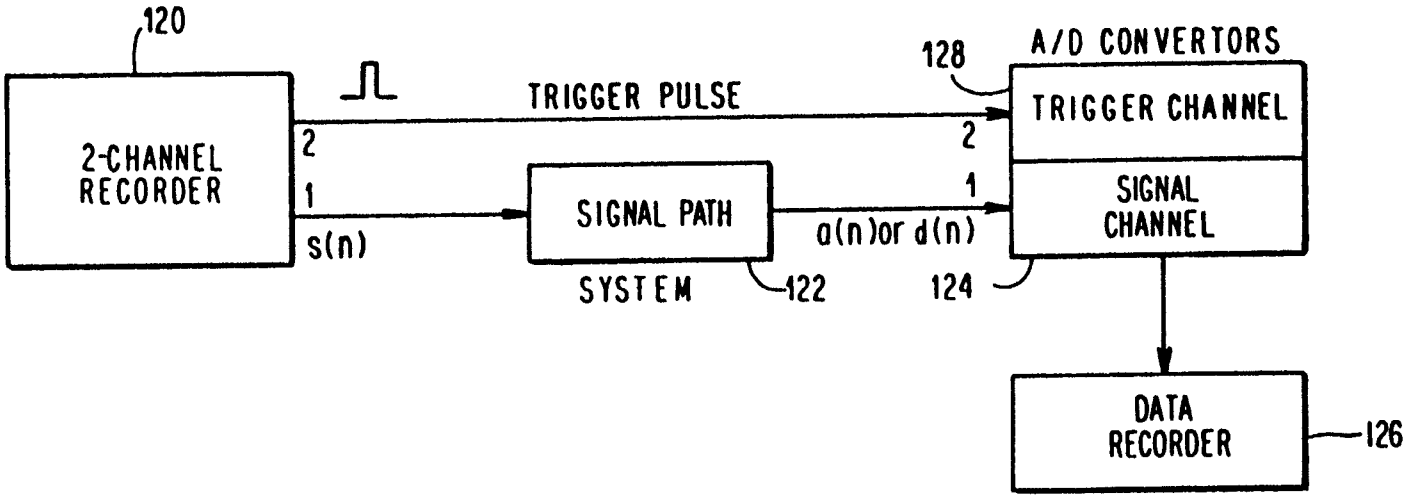
FIG. 9 is a schematic in block diagram form of a simplified embodiment used to obtain the data for an optimal filter.

As described above, when determining the coefficients of the optimal filter in a laboratory set-up the actual and desired transfer functions are typically obtained simultaneously. This approach presents a problem in the hearing aid situation so the present invention teaches the use of a recorded trigger pulse that simulates simultaneous data acquisition. FIG. 9 shows an embodiment to accomplish this data acquisition technique in which the desired and reference signals are recorded successively. More specifically, using a two channel recorder 120, such as a digital audio tape recorder, a nominally white Gaussian noise signal is recorded on channel A to form the sound source. A synchronization pulse is recorded on channel B.

Then, when collecting data the unaided eardrum digital signal for a fixed sound source location is transferred over the signal path 122 to a signal channel analog-to-digital convertor 124 and recorded as the desired signal in a digital data recorder 126. Simultaneously with transmitting the signal from the sound source on channel A the trigger pulse on channel B is transmitted and converted in an A/D convertor 128 and recorded along with the converted data in data recorder 126. This procedure continues in which pairs of unaided and aided signals are recorded for various different azimuths. By using the same trigger pulse for all data acquisitions, all signals are synchronized. This means that the composite aided and unaided signals can be derived by summation of all of the respective components.

Figure 10A:
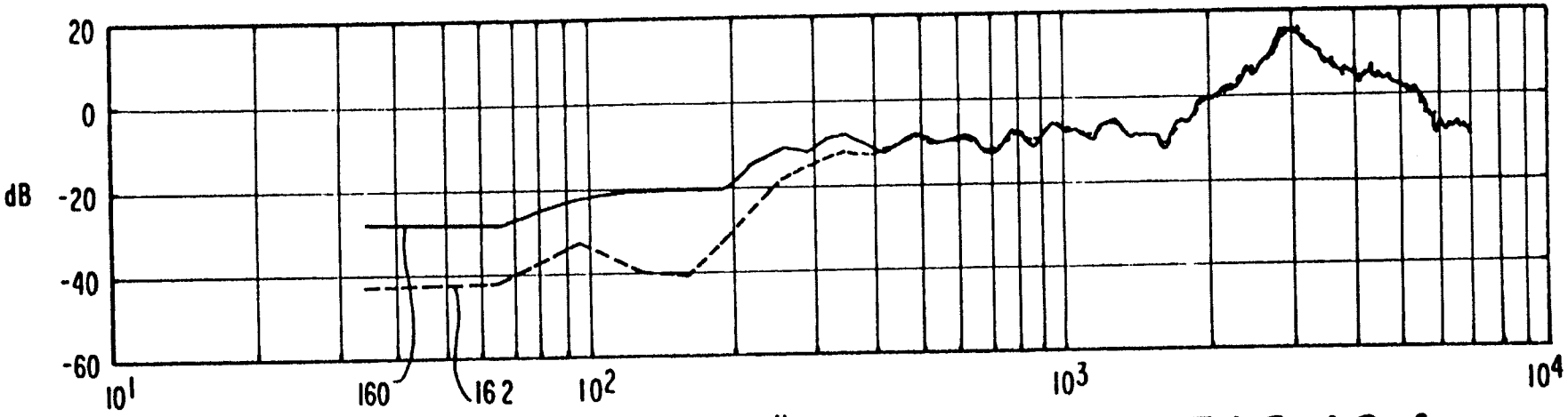
FIGS. 10A and 10B are magnitude and phase plots of measured transfer functions of the unaided versus the aided response with the optimal filter implemented in the hearing aid and representing results obtained with the system of FIGS. 8 and 9.
Figure 10B:
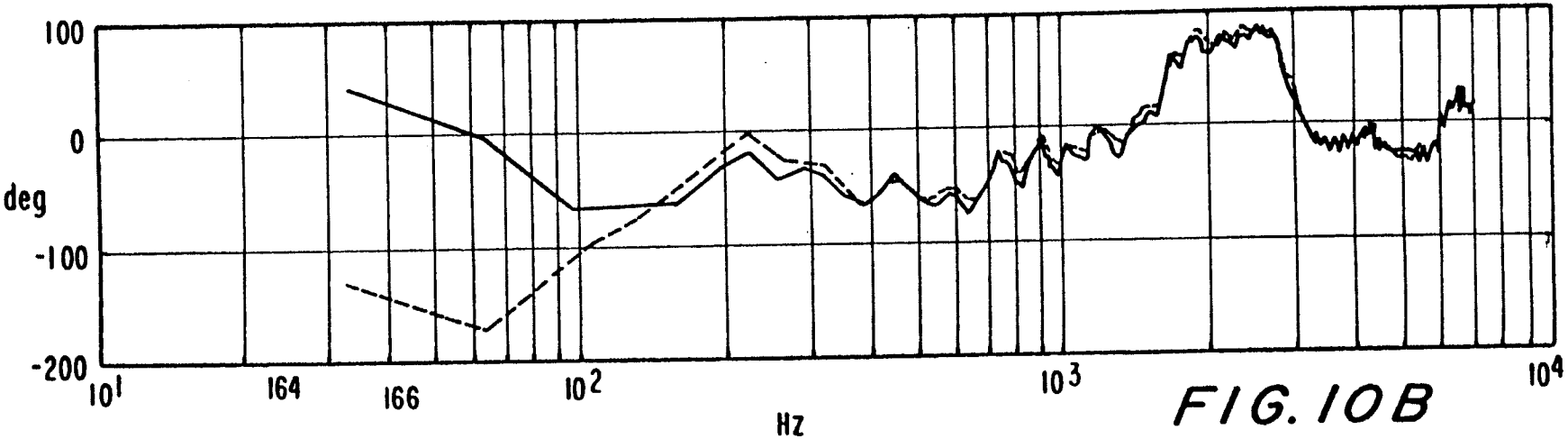

FIGS. 10A and 10B are plots of measured transfer functions of the unaided response and the aided response with the optimal filter implemented in the hearing aid, that is, in the signal path 122 of FIG. 9. The aided response is shown by the solid line 160 in FIG. 10A and the unaided response is shown by the broken line 162. Similarly, the solid line represents the aided response in FIG. 10B, whereas the broken line 166 represents the unaided response. As will be noted, a very close match in magnitude and phase response is provided.

The above description is based on preferred embodiments of the present invention, however, it will apparent that modifications and variations thereof could be effected by one with skill in the art without departing from the spirit or scope of the invention, which is to be determined by the following claims.

What is claimed is:

1. A method for obtaining coefficients of a digital filter for use in compensating effects of a hearing aid, comprising the steps of:

determining an unaided head related transfer function for each ear and for a plurality of azimuth locations of a sound source;

determining an aided head related transfer function for each ear having a hearing aid installed thereat and for the plurality of azimuth locations of the sound source;

finding a minimum phase representation of the unaided head related transfer function;

finding a minimum phase representation of the aided head related transfer function;

calculating the ratio between the unaided minimum phase representation and the aided minimum phase representation to form a target filter response; and obtaining a plurality of filter coefficients by sampling the target filter response at a plurality of frequency values corresponding to frequency increments in the digital filter.

2. A method according to claim 1, comprising the further steps of detecting a central flat response portion of the unaided head related transfer function, truncating the unaided head related transfer function to retain only the detected flat response portion, and using the truncated unaided head related transfer function in subsequent steps.

3. A method according to claim 1, comprising the further steps of detecting a central, flat response portion of the aided head related transfer function, truncating the aided head related transfer function to retain only the detected flat response portion, and using the truncated aided head related transfer function in subsequent steps.

4. A method according to claim 1, in which the step of finding the minimum phase representation of the unaided head related transfer function includes the steps of characterizing a non-minimum phase component as a bulk time delay, computing a bulk time delay component by least-squares fitting a linear function to unwrapped phase data, determining a slope of a result of the least-squares fitting, converting the slope to a time value, and subtracting the converted time value from the unwrapped phase response.

5. A method according to claim 1, in which the step of finding the minimum phase representation of the aided head related transfer function includes the steps of characterizing a non-minimum phase component as a bulk time delay, computing a bulk time delay component by least-squares fitting a linear function to unwrapped phase data, determining a slope of a result of the least squares fitting, converting the slope to a time value, and subtracting the converted time value from the unwrapped phase response.

6. A method according to claim 1, comprising the further steps of smoothing magnitude and phase components of both aided and unaided head related transfer functions.

7. A method according to claim 6, where in the steps of smoothing are performed using a five-sample moving average with uniform weighing in two smoothing passes.

8. A method recording to claim 1, wherein the step of calculating the ratio includes the step of performing complex division on the aided and unaided head related transfer functions.

9. A method according to claim 1, wherein the step of sampling includes performing least-squares frequency sampling on the target filter response to specify a target amplitude and phase response at a plurality of frequency samples.

10. A method according to claim 9, further including the step of specifying five hundred evenly spaced samples over the bandwidth of the target filter response.

11. A method for selecting filter coefficients in a digital filter for use in compensating loss of directional information to a wearer of a hearing aid, comprising the steps of:

determining an unaided head related transfer function using a binaural manikin for each ear and for a plurality of azimuth locations of a sound source;

determining an aided head related transfer function using a hearing aided binaural manikin for each ear and for the plurality of azimuth locations of the sound source;

finding a minimum phase representation of the unaided head related transfer function;

finding a minimum phase representation of the aided head related transfer function;

finding the ratio of the unaided minimum phase representation to the aided minimum phase representation; and obtaining a plurality of filter coefficients by sampling the target filter response at a plurality of frequency values corresponding to frequency increments in the digital filter.

12. A method according to claim 11, comprising the further steps of detecting a central flat response portion of the unaided head related transfer function, truncating the unaided head related transfer function to retain only the detected flat response portion, and using the truncated unaided head related transfer function in subsequent steps.

13. A method according to claim 11, comprising the further steps of detecting a central, flat response portion of the aided head related transfer function, truncating the aided head related transfer function to retain only the detected flat response portion, and using the truncated aided head related transfer function in subsequent steps.

14. A method according to claim 11, in which the step of finding the minimum phase representation of the unaided head related transfer function includes the steps of characterizing a non-minimum phase component as a bulk time delay, computing a bulk delay component by least-squares fitting a linear function to unwrapped phase data, determining a slope of a result of the least-squares fitting, converting the slope to a time value, and subtracting the converted time value from the unwrapped phase response.

15. A method according to claim 11, in which the step of finding the minimum phase representation of the aided head related transfer function includes the steps of characterizing a non-minimum phase component as a bulk time delay, computing a bulk time delay component by least-squares fitting a linear function to unwrapped phase data, determining a slope of a result of the least-squares fitting, converting the slope to a time value, and subtracting the converted time value from the unwrapped phase response.

16. A method according to claim 11, comprising the further steps of smoothing magnitude and phase components of both aided and unaided head related transfer functions.

17. A method according to claim 16, where in the steps of smoothing are performed using a five-sample moving average with uniform weighing in two smoothing passes.

18. A method recording to claim 11, wherein the step of finding the ratio includes the step of performing complex division on the aided and unaided head related transfer functions.

19. A method according to claim 11, wherein the step of sampling includes performing least-squares frequency sampling on the target filter response to specify a target amplitude and phase response at a plurality of frequency samples.

20. A method according to claim 19, further including the step of specifying five hundred evenly spaced samples over the bandwidth of the target filter response.

21. A method for obtaining coefficients of a digital filter for use in compensating effects of a hearing aid, comprising the steps of:

producing an audio signal having a predetermined frequency content at a predetermined sound pressure level at a first time;

producing a trigger pulse simultaneously with the audio signal;

detecting the produced signal at an eardrum location in the absence of a hearing aid and recording the detected signal in synchronism with the trigger pulse on a first track of a magnetic tape;

inserting a hearing aid adjacent the eardrum location;

producing the audio signal at a second, later time;

producing the trigger pulse simultaneously with the audio signal the second time;

detecting the produced signal at the eardrum location in the presence of the hearing aid and recording the detected signal in synchronism with the trigger pulse on a second track of a magnetic tape in time alignment with the onset of the recorded signal in the first track by aligning the recorded trigger pulse;

sampling the signals recorded in the first and second tracks; and calculating digital filter coefficients from the sampled signals using discrete-time Wiener equations.

22. A method according to claim 21, wherein the step of recording the detected signal includes converting the detected signal to a digital signal and controlling the recording in response to the trigger pulse.

23. A method according to claim 21, wherein the step of producing an audio signal comprises producing a white, Gaussian, noise signal.

24. A method according to claim 21, wherein the step of producing an audio signal at a first time and a second later time comprise the steps of producing the audio signal at different azimuths relative to the eardrum location, maintaining the sound pressure level constant, summing all detected signals in the absence of the hearing aid to produce a composite unaided signal, and summing all detected signals in the presence of the hearing aid to produce a composite unaided signal.

25. A method according to claim 24, wherein the step of sampling includes sampling the aided and unaided composite signals to obtain estimates of correlation values for use in the step of calculating.

26. A method according to claim 25, wherein the step of calculating includes computing an auto-correlation matrix R and a cross-correlation matrix P from the sampled signals of the composite aided and unaided signals.

27. A method according to claim 26, wherein the Wiener solution is $w=R^{-1}P$.

* * * * *